United States Patent [19]

Spadoni-Censi

[11] 4,281,475

[45] Aug. 4, 1981

[54] APPARATUS FOR OPENING AND CLOSING A DOOR

[76] Inventor: Vittorio Spadoni-Censi, Av. Los Mangos, Res. Nina (Sotano) Sector Las Delicias, Sabana Grande, Caracas 105, Venezuela

[21] Appl. No.: 46,617

[22] Filed: Jun. 8, 1979

[51] Int. Cl.[3] ..... E05F 15/10

[52] U.S. Cl. ..... 49/28; 49/199; 318/266

[58] Field of Search ..... 49/25, 26, 28, 29, 30, 49/199, 140, 264; 318/266

[56] References Cited

U.S. PATENT DOCUMENTS

| | | | |
|---|---|---|---|
| 2,568,808 | 9/1951 | Johanson | 49/140 X |
| 3,733,747 | 5/1973 | Fox et al. | 318/266 X |

FOREIGN PATENT DOCUMENTS

| | | | |
|---|---|---|---|
| 492284 | 4/1953 | Canada | 49/140 |

*Primary Examiner*—Kenneth Downey
*Attorney, Agent, or Firm*—Karl F. Ross

[57] ABSTRACT

A door opener has a housing in which is contained a small fractional-horsepower reversible motor whose output shaft is connected to a worm gear journaled in the apparatus and meshing with a main gear in turn connected to an output member constituted as a sprocket. A clutch is provided between the main gear and the sprocket for disconnecting the two when rotation of the output member is resisted with a torque exceeding a given limit torque. A step-down transmission is connected between this output member and a control disk that carries opening and closing stops that are respectively engageable with opening and closing switches of an electrical control circuit. Thus the angular position of the control disk is directly related to the position of a door connected to the output member. A switch is provided which is actuated whenever the torque exerted between the motor and the worm exceeds a predetermined limit, and serves to reverse the displacement direction of the door in this case. Thus in the event the door strikes an object it will automatically reverse.

11 Claims, 10 Drawing Figures

APPARATUS FOR OPENING AND CLOSING A DOOR

FIELD OF THE INVENTION

The present invention relates to a door-opening apparatus. More particularly this invention concerns an apparatus used for opening and closing a door, such as an overhead garage door or a sliding door.

BACKGROUND OF THE INVENTION

Door openers for garage doors are known which are operated by radio-control units and serve to raise and lower a garage door. Such devices normally have a motor that is provided with a sprocket over which a chain connected to the door is spanned. A radio-control receiver is connected to this motor is operate it in a direction tending to close the door if it is in the open position or to open the door if it is in the closed position each time it receives a signal from a transmitter normally carried in the vehicle that uses the garage.

Such units are typically relatively bulky. They normally use a motor having a capacity of at least one-fifth horsepower, and normally weigh at least 20 kilograms. It is necessary to provide such a large motor as stepping down the force of a smaller motor can result in serious accidents should the door strike a person or vehicle while opening or closing. A larger motor can stall without being seriously damaged while a smaller motor that is stepped down to derive the same torque would be damaged.

OBJECTS OF THE INVENTION

It is therefore an object of the present invention to provide an improved apparatus for opening and closing a door.

Another object is to provide such an apparatus which is of relatively reduced size and weight, yet which can replace much larger and heavier units.

Another object is to avoid the disadvantages of the prior-art door opening and closing devices.

SUMMARY OF THE INVENTION

These objects are attained according to the instant invention in a door opening apparatus wherein a relatively small reversible motor is provided in the housing and has a first transmission linking its motor output shaft to a worm gear that forms part of a second transmission that in turn is linked to a rotatable output member that is connectable to a door. Thus rotation of the motor output in one direction will rotate the output member in one direction and open the door and rotation in the opposite direction will reverse this action and close the door. A clutch is provided in the second transmission for decoupling the worm gear from the output member when rotation of the output member is resisted with a torque exceeding a given limit torque. A control disk is provided in the housing connected via a third transmission to the output member so that this control disk rotates jointly with but at a much slower angular speed than the output member. Opening and closing stops mounted on this control disk coact with opening and closing switches forming part of an electrical controller that allows operation of the motor only in a sense to open the door when the closing stop engages the closing switch and for allowing operation of the motor only in a sense to close the door when the opening stop engages the opening switch. In intermediate positions the door can be moved in either direction. Finally, a safety device is provided for reversing the operation of the motor when the stops are out of engagement with the switches and displacement of the door is resisted with a force exceeding a given limit force.

Thus with the system according to the instant invention not only will the door reverse itself if it strikes an object or its travel is impeded, but, if for some reason this automatic reversal is not effected, a clutch within the mechanism decouples the motor from the door. This clutch can also be decoupled manually to allow the door to be operated independently of the motor, as in the event of a power failure.

The motor according to this invention is of the self-braking type. Thus it completely eliminates the necessity of providing a separate brake to hold the door once the motor is shut off and it is in one of its end positions. As the output speed of this fractional-horsepower motor is stepped down, its braking action will correspondingly be stepped down so that a relatively small braking torque will be effective to rigidly lock the door in place.

The provision of means that serves merely for detecting a situation where the force being exerted against the door is above a predetermined limit completely eliminates the necessity of providing external sensors or the like to determine whether an object is impeding displacement of the door. Instead this situation can be detected completely inside the control unit, so that a substantial saving in construction costs is obtained, while the system insures that no matter what the problem is that is impeding the door, the appropriate reversal will be effected.

BRIEF DESCRIPTION OF THE DRAWING

FIG. 5 is a top view of the apparatus according to this invention with the cover removed;

SPECIFIC DESCRIPTION

Figure 1:
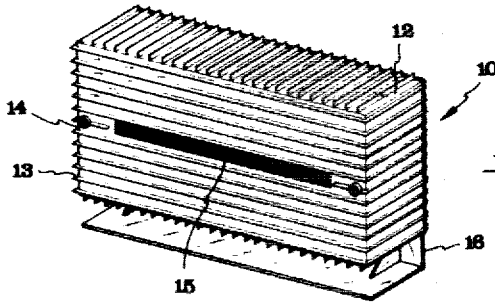
FIG. 1 is a perspective view of the apparatus according to this invention.

A door-closing apparatus 10 according to this invention has a rectangular base plate 11 and a parallelopipedal cover 12 fitted over the baseplate 11 and secured thereto by means of screws 14 received in holes **14*a* in the baseplate 11. The base plate 11 and cover 12 are both formed with heat-dissipating ribs 13. The cover 12 is formed centrally with a hole 15 and is formed on one side with a hole 18*a* (see FIG. 4). Normally the arrangement is mounted by means of an L-shaped bracket 16 secured to the base plate 11 by screws 17** to a fixed support.

Extending through the one flange of the bracket 16 is a shaft carrying a toothed wheel or sprocket 39, and two idler pulleys or sprockets 111 and 112 are also mounted on this same flange.

Figure 2:
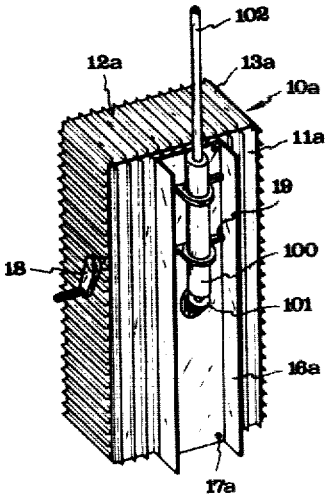
FIG. 2 is a rear perspective view of a variation on the apparatus of this invention.
Figure 3:
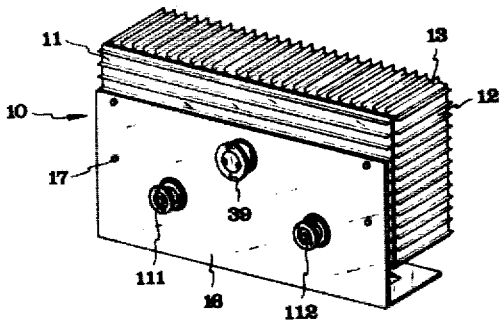
FIG. 3 is a rear perspective view of the apparatus of FIG. 1.

It is also possible as shown in FIG. 2 for an apparatus 10*a* to have a base plate 11*a* and cover 12*a* formed with ribs 13*a*. Here a U-section bracket 16*a* secured in place by screws 17*a* is provided with flanges or supports 19 for a guide tube 100 of a shaft 102 carrying a bevel gear 101 meshing with a bevel gear replacing the sprocket 39. FIG. 2 also shows a crank 18 which can be inserted through the hole 18*a* for a purpose described below.

Figure 4:
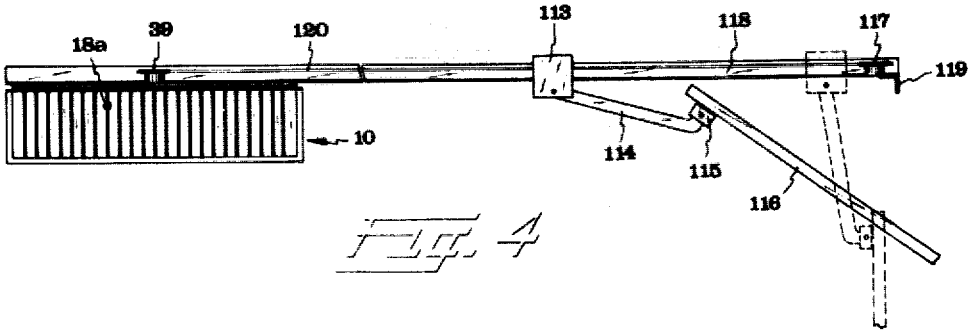
FIG. 4 is a side view showing the apparatus according to this invention when installed.
Figure 3:
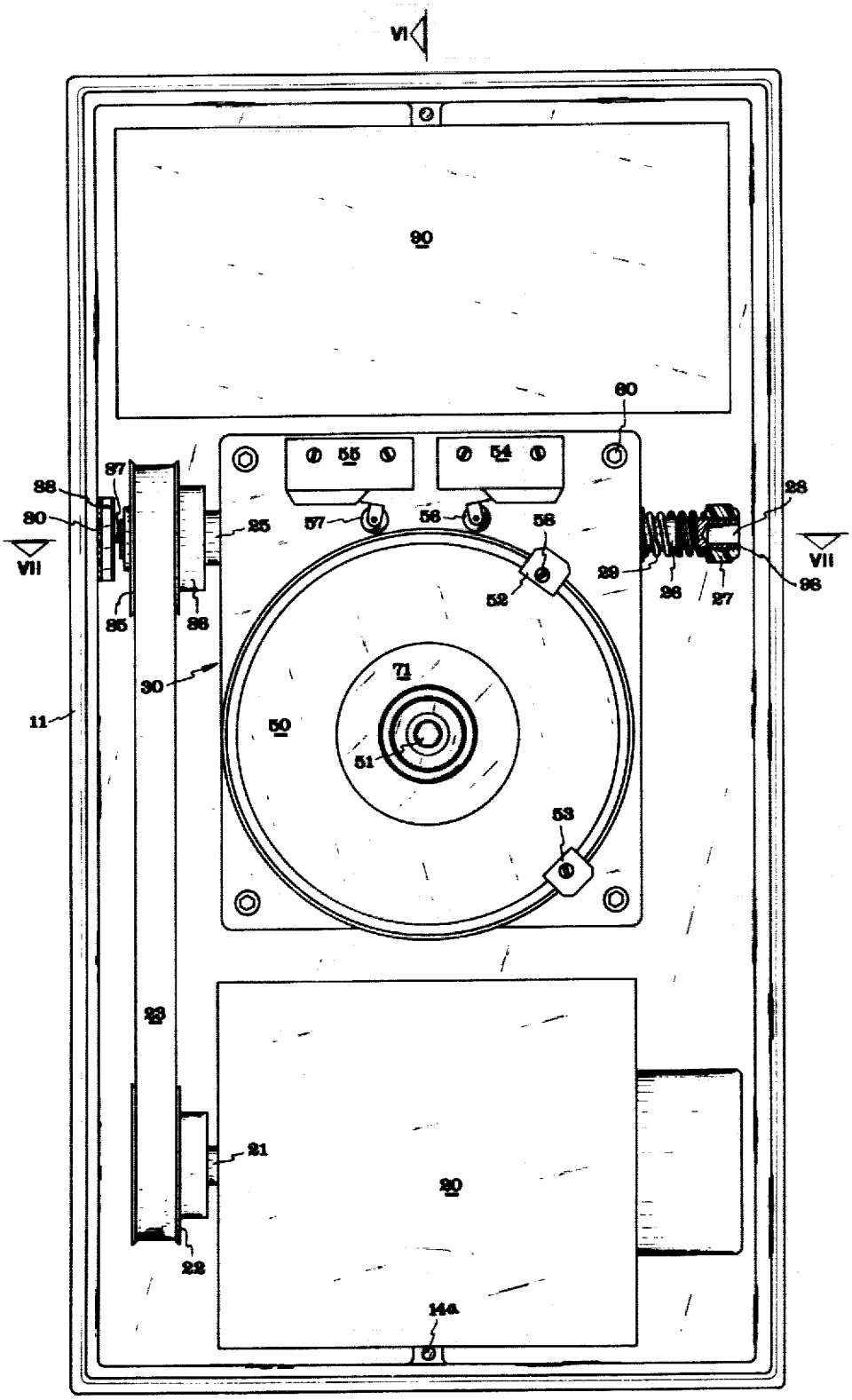

FIG. 4 shows how the apparatus 10, which internally is identical to the apparatus 10*a*, is secured to a T-rail 118 fixed to a support 119. A trolley 113 is displaceable along this rail and is connected to a chain 120 reeved over the sprocket 39 and over an idler sprocket 117. This trolley 113 carries an arm 114 pivoted at 115 on an overhead-type door 116. It would also, of course, be possible to secure the arm 114 to a sliding door, or to virtually any type of door or window structure.

Figure 6:
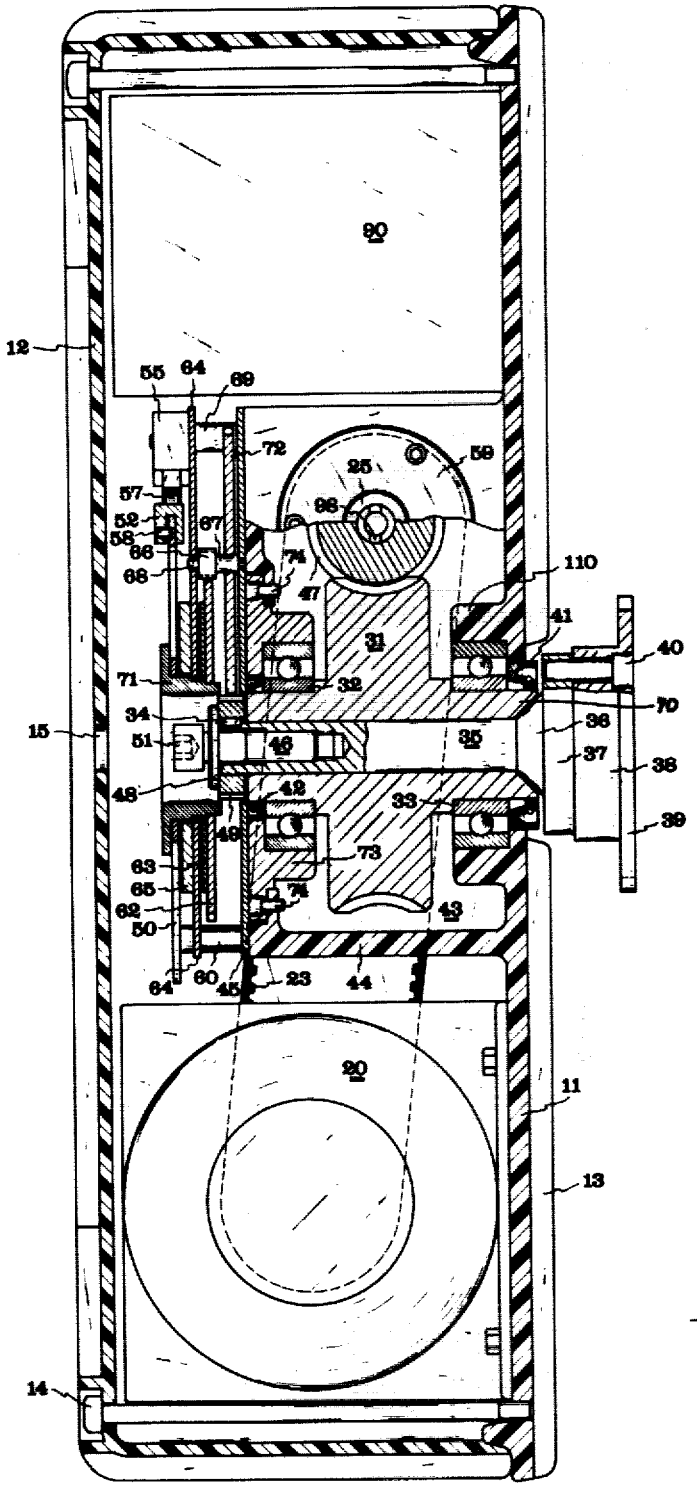
FIGS. 6 and 7 are sections taken along lines VI—VI and VII—VII of FIG. 5.
Figure 8:
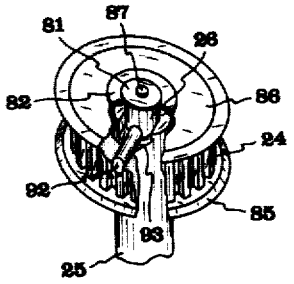
FIG. 8 is a partly broken-away perspective view of a detail of the apparatus according to this invention.
Figure 9:
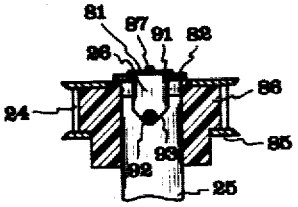
FIG. 9 is a section through the detail of FIG. 8.

Inside the housing 11, 12 as shown in FIGS. 5 and 6 there is a reversible electric motor 20 of the self-locking type and having an output shaft 21. A transmission 30 is driven by this motor and the entire device is controlled by a circuit shown at 90.

Figure 7:
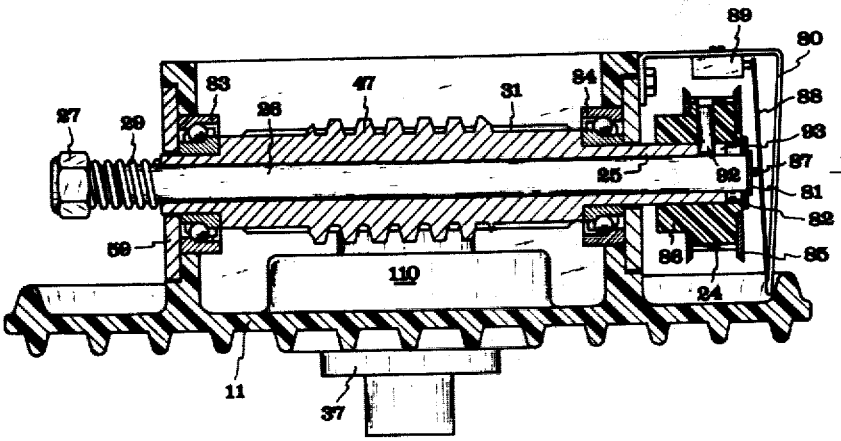

More particularly the output shaft 21 carries a toothed wheel or pulley 22 connected via a toothed belt 23 to a driven pulley or wheel 86 carried as shown in FIG. 7 on a tubular shaft 25. Teeth 24 formed in the pulley 86 ensure synchronous rotation of this pulley 86 with the pulley 22 which is substantially the same size. The tubular shaft 25 in turn is formed with a worm gear 47 meshing with a main drive gear 31 carried on a respective tubular shaft 70. The interaction of the worm gear 47 and the drive gear 31 steps down the rotation speed of the motor 20 greatly while increasing its torque. Furthermore this transmission is of the unidirectional type, that is rotation of the shaft 25 is readily transmitted to the gear 31, but torque applied to the gear 31 cannot normally rotate the shaft 25. Thus even though the motor 20 is of the self-braking type reverse driving of the motor 20 through the transmission gears 47 and 31 is virtually impossible.

More particularly, as shown in FIG. 6, the shaft 70 of the gear 31 is received at one end in a ball bearing 32 in turn mounted in an element 73 secured via screws 74 to the rim of a wall 44 unitarily formed with the base plate 11. In addition this base plate 11 is formed with a raised portion 110 holding a bearing 33 for the other end of the shaft 70. Glands 41 and 42 are provided between the base plate 11 and member 73. Similarly as shown in FIG. 7 plates 59 are provided at the bearings 83 and 84 in which the shaft 25 is rotatable, so that a closed chamber 43 is formed which is maintained filled with a lubricant. Thus these main drive gears are continuously lubricated for long life.

The tubular shaft 25 coaxially receives a solid core shaft 26 that can move axially inside the tubular shaft 25. In addition the tubular shaft 25 is formed with an axially open cut-out 91 having a pair of inclined sides or flanks 93. The body of the pulley 86 has a radially inwardly extending pin 92 received in this cutout 93. In addition a bump-forming screw 87 secures a washer 81 to the one end of the shaft 26, which washer 81 in turn secures a washer 82 to this shaft which bears axially on an end plate 85 of the synthetic-resin gear or pulley 86. The bump-forming screw 87 is engageable with an arm 88 of a microswitch 89 mounted in a shield 80 surrounding the pulley 86.

At its other end the core shaft 26 is threaded and formed with an axially open cylindrical recess 28, and with a cross-slot 98. A nut 27 is screwed over this end and a spring 29 bears axially between this nut 27 and the tube shaft 25. Thus this spring 29 biases the core shaft 26 axially so as to urge the pin 92 into the crotch between the flanks 93.

During normal operation of the device, as described in greater detail below, the motor 20 will drive the pulley 86 synchronously with the pulley 22. So long as rotation of the worm 47 is not resisted with an excessive torque, the spring 29 will hold the pin 92 in the base of the cutout 92. When, however, rotation of the worm 47 is resisted with a force exceeding a predetermined maximum, the pin 92 will ride up on one of the flanks 93, thereby compressing the spring 29 and pulling the shaft 26 axially. This will bring the bump screw 87 into engagement with the arm 88 to momentarily close the switch 89. As will be described below such momentary closing of the switch 89 will reverse the rotation direction of the motor 20.

The cross-slot 98 in the core shaft 26 is aligned with the hole 18*a* of the cover 12. The crank 18 has a cross pin which fits in this slot 98. Thus the device can be manually operated by insertion of the crank 18 into the hole 18*a* to couple it with the core shaft 26. If the motor 20 is not of the self-braking type, and the one-way transmission formed by the gears 47 and 31 is relied on to prevent back driving of the motor 20, this crank will therefore easily be able to operate the device manually.

The tube shaft 70 of the gear 31 receives a core shaft 35 formed at one end with a frustoconical flared portion 36 and a cylindrical head 37 and formed at its opposite end with an axially open threaded recess receiving a screw 48 having an Allen recess 51 in its head. This Allen recess 51 is aligned with the hole 15. The sprocket 39 has a cylindrical portion 38 secured by means of screws 40 to the cylindrical portion 37 so that the sprocket 39 is rotationally coupled to the core shaft 35. The head of the screw 46 bears via a washer 45 on a small-diameter pinion 49 rotationally locked by a key 34 to the shaft 35.

The core shaft 35 can rotate within the tube shaft 70, but is normally frictionally locked thereto. The interengagement of the end portion 36 with the correspondingly frustoconically flared end of the tube shaft 70 constitutes a clutch whose degree of frictional engagement can be controlled by the tightness of the screw 46. Thus if the screw 46 is very tight considerable torque can be transmitted from the shaft 70 to the shaft 35. During installation it is standard practice to loosen the screw 46 considerably, so that the sprocket 39 can turn freely relative to the gear 31. Only once the device is fully adjusted and ready to use is the screw 46 tightened to a torque ensuring sufficient force transmission from the shaft 70 to the shaft 35. The amount of force that can be transmitted is determined by this torque and is set to be somewhat greater than the force at which the sprocket 86 will spring outwardly to operate the switch 89 as described above. Thus in the event of failure of the reversing circuit to be controlled by the switch 89 the clutch will act and allow slipping of the shafts 35 and 70 relative to each other so that the motor 20 will not overheat and destroy itself. The Allen recess 51 can, instead, be a nonstandard recess, as for example of pentagonal shape, to ensure that only a person with the appropriate tool can thus decouple the arrangement.

The circuitry which stops the motor 20 when the door has reached either of its end positions is mounted on a spacer plate 64 secured via screws 60 and spacers 69 on the end plate 45. A large-diameter stamped gear 72 meshes with the small-diameter main drive gear 49 keyed to the shaft 35 and rotates about an axle 67 pivoted in the end plate 45. This axle 67 carries a very small pinion 66 and is journaled via a stub shaft 68 in the plate 64. This very small pinion 66 in turn meshes with a large-diameter gear 62 separated from the plate 64 by a spacer 63 and rotatable about the same axis as the core shaft 35. A tubular sleeve 71 is fixed to the large-diameter gear 62.

It should be apparent that the sleeve 71 will turn at a much slower rate than the shaft 35, due to the double stepdown by means of the gear train constituted by the gears 49, 72, 66, and 62. This low-speed rotation of the element 71 is transmitted to a disk 50 fixed to and spaced from the plate 64 by means of a washer 65. Stops 52 and 53 are locked to the rim of the disk 50 by means of screws 58. In addition microswitches 54 and 55 having respective rollers 56 and 57 can be engaged by these stops 52 and 53 to open and close circuits described below. These microswitches 54 and 55 are of the normally closed type which open when engaged by the respective stops 52 and 53 which as will be described below are associated with the closed and open positions of the door when they engage the respective rollers 56 and 57. Thus although the sprocket 39 will have to turn many times to move the door 116 between its open and closed positions the disk 50 will itself only rotate through approximately 270° between these door end positions.

Figure 10:
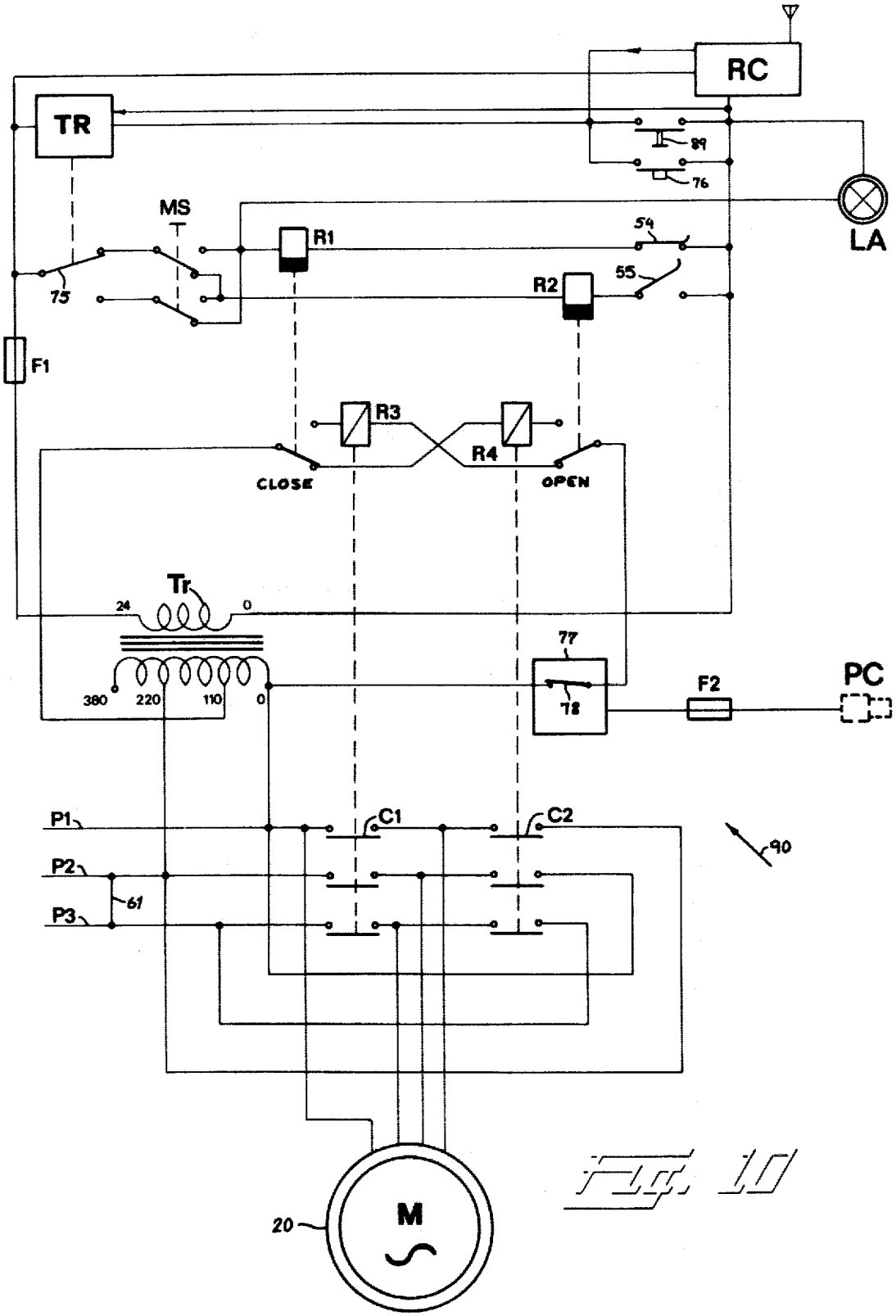
FIG. 10 is a schematic showing the control circuit of the apparatus according to this invention.

FIG. 10 illustrates the circuit for the arrangement according to this invention. The motor 20 is shown to be wound for three-phase operation and here connected via two switches C1 and C2 to the three-phases P1, P2, and P3 of the power source. It is noted that here a jumper 61 extends between phases P2 and P3 so that actually the motor 20 is operating as a single-phase motor. Also connected across phases P1 and P2 is the primary of a transformer TR whose 24-volt secondary is connected via a fuse F1 to various switches as well as to a biphase stepping relay TR and a remote control receiver RC. A pair of solenoids or relays R3 and R4 is connected across a tap of the primary of the transformer TR and respectively operate contacts C1 and C2 for operating the motor 20 for rotation in directions corresponding to closing or opening of the door 116 respectively.

The biphase stepping relay TR forms a single-pole double-throw switch connected via a double-pole double-row manual reversing switch MS to two time relays R1 and R2 respectively connected in series with the switches 54 and 55. The stepping relay TR moves its single-pole double-throw switch 75 from one position to the other each time it receives an input pulse, either from the radio-control receiver RC, or from the switch 89, or from a manual operation switch 76.

A lamp LA is connected in parallel with the relay R1 and switch 54 so as to be illuminated whenever the door is closing or closed. In addition a photocell PC is connected via a fuse F2 to a control circuit 77 incorporating a switch 78 which opens when the photocell PC is appropriately energized. Thus this photocell can be part of an electric-eye circuit preventing operation of the door opener whenever a light beam is blocked, or whenever something is in the way.

The various components shown in FIG. 10 are in the position they would be in if the door were completely open, so that the stop 53 engages the roller 57 and opens the switch 55, and before any signal is given to close the door. It can be seen that the circuit through the relay R2 is opened by the switch 55 so that neither of the relays R3 or R4 is energized and the contacts C1 and C2 are all open.

The stepping relay TR can be operated to reverse its switch 75 either by means of the receiver RC or switch 76. Such reversal will energize the time relay R1, which in turn will energize relay R3 and set the motor 20 turning in a direction that will close the door. As soon as the door moves out of its fully open position the switch 55 will close, however since the relay R2 is no longer connected across the secondary of transformer TR, this will have no effect. The lamp LA will also light the instant the door starts to close. If the photocell PC is set below the lamp LA which itself can be set up immediately next to the door on the inside, this photocell PC and its circuit 77 can be set up only to allow the door to continue closing when the photocell PC receives the light from the lamp LA, indicating that nothing is under the door.

Under normal circumstances the door will move into the closed position until the stop 52 will strike the roller 56 and open the switch 54. This action will open circuit the relay R1 and de-energize the motor 20.

Should the door strike an obstruction, the switch 89 will be closed at least momentarily by the torque exerted back through the transmission on the gear 47. Such momentary closing of the switch 89 will feed a pulse to the relay TR, reversing its switch 75 and thereby reversing the rotation direction of the motor M.

I claim:

1. A door-opening appartus comprising:

a housing;

a reversible motor in said housing having a motor output;

a wormgear journaled in said housing;

first transmission means for linking said motor output to said wormgear for joint rotation;

a rotatable output member connectable to the door and rotatable in one sense to open said door and in the other sense to close said door;

second transmission means for linking said wormgear to said output member for joint rotation;

clutch means in said second transmission means for decoupling said wormgear from said output member when rotation of said output member is resisted with a torque exceeding a given limit torque;

a control disk in said housing;

third transmission means for positively mechanically linking said control disk to said output members for rotating said control disk jointly with but at a much slower angular speed than said output member.

an opening stop and a closing stop mounted at angularly offset locations on said control disk;

respective opening and closing switches engageable with said opening and closing stops in open and closed positions of said door;

electrical control means connected to said switches and to said motor for allowing operation of said motor only in a sense to open said door when said closing stop engages said closing switch and for allowing operation of said motor only in a sense to close said door when said opening stop engages said opening switch; and safety means for reversing the operation of said motor when said stops are out of engagement with said switches and when displacement of said door is resisted with a force exceeding a given limit force.

2. The apparatus defined in claim 1 wherein said first transmission means includes an input drive wheel connected to said motor output and continuously jointly rotatable therewith, said electrical control means including;

an outer tubular shaft member carrying said wormgear;

an inner shaft member axially and angularly displaceable in said outer shaft member, one of said members being formed with an axially V-shaped cutout;

a pin on the other of said members engaging radially in said pin;

spring means for urging said pin axially into said cutout, whereby relative rotation of said shaft members will axially displace said inner shaft member in said outer shaft member into an outer position; and switch means engageable with said inner shaft member only in said outer position thereof for reversing said motor.

3. The apparatus defined in claim 1 wherein said housing is formed with a substantially closed chamber containing both of said transmission means and generally filled with a lubricant.

4. The apparatus defined in claim 1, further comprising means including holes formed in said housing for access from outside said housing to said wormgear and to said clutch means.

5. The apparatus defined in claim 1 wherein said second transmission includes a main gear meshing with said wormgear, said clutch means including:

a core shaft extending coaxially through said main gear and rotationally fixed to said output member;

axially interengageable friction surfaces on said core shaft and on said main gear, said core shaft being rotational inside and relative to said main gear; and tightenable means for urging said surfaces axially together with a presettable force, whereby when rotation of said output member is resisted with a torque exceeding said given limit torque said surfaces slip relative to each other.

6. The apparatus defined in claim 5 wherein said tightenable means is a screw operatively engaged between said core shaft and said main gear, said housing being formed with a throughgoing hole giving access from outside to said screw.

7. The apparatus defined in claim 5 wherein said surfaces are substantially frustoconical.

8. The apparatus defined in claim 1 wherein said output member is a sprocket.

9. The apparatus defined in claim 1 wherein said output member is a bevel gear.

10. The apparatus defined in claim 1 wherein said electrical control means includes:

opening switch means connected between said opening switch and said motor for operating said motor when energized;

closing switch means connected between said closing switch and said motor for operating said motor when energized;

means for generating an operation pulse; and means alternable between two states in response to said pulse, said opening switch means being enabled in one of said states and said closing switch means in the other state.

11. A door-opening apparatus comprising:

a housing;

a reversible motor in said housing having a motor output;

a wormgear journaled in said housing;

first transmission means for linking said motor output to said wormgear for joint rotation, said first transmission means including an input drive wheel connected to said motor output and continuously jointly rotatable therewith;

a rotatable output member connectable to a door and rotatable in one sense to open said door and in the other sense to close said door;

second transmission means for linking said wormgear to said output member for joint rotation;

clutch means in said second transmission means for decoupling said wormgear from said output member when rotation of said output member is resisted with a torque exceeding a given limit torque;

a control disk in said housing;

third transmission means for rotating said control disk jointly with but at a much slower angular speed than said output member;

an opening stop and a closing stop mounted at angularly offset locations on said control disk respective opening and closing switches engageable with said opening and closing stops in open and closed positions of said door;

electrical control means connected to said switches and to said motor for allowing operation of said motor only in a sense to open said door when said closing stop engages said closing switch and for allowing operation of said motor only in a sense to close said door when said opening stop engages said opening switch;

said electrical control means including:

an outer tubular shaft member carrying said wormgear, an inner shaft member axially and angularly displaceable in said outer shaft member, one of said members being formed with an axially V-shaped cutout, a pin on the other of said members engaging radially in said pin;

spring means for urging said pin axially into said cut-out whereby relative rotation of said shaft members will axially displace said inner shaft member in said outer shaft member into an outer position, and switch means engageable with said inner shaft member only in said outer position thereof for reversing said motor; and safety means for reversing the operation of said motor when said stops are out of engagement with said switches and when displacement of said door is resisted with a force exceeding a given limit force.

* * * * *